United States Patent [19]

Yamada et al.

[11] 4,132,590

[45] Jan. 2, 1979

[54] METHOD OF PRODUCING INORGANIC BOARDS

[75] Inventors: Hirofumi Yamada; Noboru Takaki, both of Amagasaki; Michio Masuda, Osaka, all of Japan

[73] Assignee: Kubota, Ltd., Osaka, Japan

[21] Appl. No.: 889,533

[22] Filed: Mar. 23, 1978

[30] Foreign Application Priority Data

May 13, 1977 [JP] Japan ..... 52-55763

[51] Int. Cl.[2] ..... D21F 11/00; F26B 5/04; C04B 1/00; C04B 15/14

[52] U.S. Cl. ..... 162/145; 34/16; 34/18; 34/23; 34/92; 106/119; 106/120; 162/146; 162/153; 162/154; 162/155; 162/206; 162/207; 162/221; 162/225; 264/82; 264/101; 264/102; 264/333

[58] Field of Search ..... 162/153, 154, 204, 206, 162/207, 221, 225, 145, 155, 146; 34/16, 18, 23, 92; 106/102, 120, 119; 264/82, 101, 102, 333, DIG. 43 C

[56] References Cited

U.S. PATENT DOCUMENTS

| | | | |
|---|---|---|---|
| 3,250,836 | 5/1966 | Ulfstedt | 264/82 |
| 3,327,032 | 6/1967 | Adams | 264/82 |

FOREIGN PATENT DOCUMENTS

| | | | |
|---|---|---|---|
| 559982 | 7/1958 | Canada | 264/82 |

*Primary Examiner*—S. Leon Bashore
*Assistant Examiner*—Peter Chin
*Attorney, Agent, or Firm*—Moonray Kojima

[57] ABSTRACT

A method of producing an inorganic substance board, wherein after preparation, such as by use of paper making process, the board is hardened in an autoclave with saturated steam at a high temperature, high pressure and for a suitable length of time, and after hardening, subjecting the board to one or more drying cycles comprising a vacuum treatment at 60 to 300 Torrs, for a suitable length of time to enable the core of the board to reach a suitable temperature, the application of saturated steam at 2 to 12 Kg/cm$^2$ pressure and 120 to 190° C temperature for a period of time sufficient to allow the core to reach a suitable temperature. The number of cycles is preferably 10 or less. Advantageously, the inventive drying treatment prevents efflorescence and warping of the boards.

7 Claims, 4 Drawing Figures

METHOD OF PRODUCING INORGANIC BOARDS

BACKGROUND OF THE INVENTION

This invention relates to a method of producing board material using an autoclave for aging treatment, and more particularly to a method which enables drying of the aged boards in the same autoclave.

In the manufacture of boards and inorganic material, such as those containing calcium silicate, the board is finished by painting plastic substance onto the board after aging. Usually, an autoclave is used for the aging treatment. The water content in such treated material is excessively high so that the board must first be dried before painting.

When an autoclave is used for aging, the water content of the board depends upon the period of aging, temperature of the steam used, etc. Ordinarily, the water content falls to about 50% after formation of the board, in the aging process. The board must then be dried to a water content of 14 to 20% before any painting operation.

Heretofore, hot air driers have been used for drying the hardened material. But disadvantageously, the equipment and process required for such hot air drying are too expensive to enable such method to be used on an industrial basis. Also, it has been found that such hot air drying causes warping of the material, and in the case of board material produced by the paper making process, such hot air drying causes exfoliation between the layers. Thus, the board material after drying was not optimally suitable and also was expensive.

SUMMARY OF THE INVENTION

Accordingly, an object of the invention is to eliminate the above mentioned and other deficiencies of the prior art.

Another object of the invention is to produce inexpensively and on an industrial basis, an inorganic substance board which has been appropriately dried to have an optimal water content.

A further object of the invention is to produce such inorganic substance board without warping or exfoliation.

A still further object of the invention is to produce such inorganic substance board without the necessity of expensive collateral equipment.

The invention encompasses a method of producing an inorganic substance board, wherein the prepared board is placed in an autoclave and aged, i.e. hardened, by treatment with saturated steam at high temperature and pressure and for a suitable length of time, and wherein after such hardening treatment, one or more drying cycles are applied with the board being held in the same autoclave. The cycles comprise a vacuum treatment of 60 to 300 Torrs for a suitable length of time to enable the temperature of the core of the board to fall to a suitable temperature, then saturated steam at a pressure of 2 to 12 Kg/cm$^2$ and at a temperature of about 120 to 190° C. is applied for a period of time sufficient to allow the core to reach a suitable temperature. In one embodiment, the vacuum was applied for about 30 minutes and the temperature of the core reached 70° C., then the saturated steam was also applied for about 30 minutes and the core reached about 143° C. before the next drying cycle was applied. The number of drying cycles is preferably 10 or less. Advantageously, by use of such drying cycles applied to the boards in the autoclave, the boards are dried to a desired water content without warping or exfoliation.

A feature of the invention is use of one or more cycles of vacuum at a suitable pressure, temperature and time, and saturated steam at suitable pressure, temperature and time, to dry an inorganic substance board.

Another feature is the use of the same autoclave as used in the hardening treatment for the subsequent drying process.

A further feature is the placement of a plurality of boards in upright parallel manner in the autoclave for the hardening and drying process.

Further features are use of a drying treatment comprising one or more cycles of alternate vacuum treatment and saturated steam treatment, wherein the vacuum is at 60 to 300 Torrs pressure, and for a suitable period of time to allow the temperature of the core of the board to reach a suitable temperature, such as for 30 minutes and 70° C., and wherein the saturated steam is at a pressure of 2 to 12 Kg/cm$^2$ and a temperature of about 120 to 190° C. for a period of time sufficient to enable the temperature of the core to reach a suitable temperature, such as 30 minutes and 143° C.

Another feature is the use of the autoclave for age hardening treatment employing saturated steam at 2 to 12 Kg/cm$^2$, at a temperature of about 120 to 190° C., for a period of time of about 8 to 16 hours.

A still further feature of the invention is the composition of the board which is subjected to the age-hardening step and drying cycles.

DETAILED DESCRIPTION OF PREFERRED EMBODIMENTS

The invention encompasses the preparation of the board from a slurry using for example a paper making process, then subjecting the raw board to one or more age hardening treatments, such as first in an aging chamber, and then in an autoclave using saturated steam, and then subjecting the hardened board to one or more drying cycles in the same autoclave. The drying cycles comprise alternate vacuum treatment and saturated steam treatment, to stepwisely bring down the water content in the board.

The inventors have discovered that a set of parameters to be outlined hereinbelow and using the same autoclave in which the age hardening treatment was carried out, efficiently and economically produced the desired reduction of water content in an inorganic substance board without any exfoliation of the layers and without warping.

Specific heat of the board to be dried is as follows:

$$C = (1) \times (M)/100 + A(100 - M/100) \quad (1)$$

wherein "C" denotes specific heat of the board to be dried; "M" is the water content of the board in percents; "A" is the specific heat of bone dried board material.

Assuming the water content of the board aged in the autoclave is M% and temperature of the board, which corresponds to the temperature of the saturated steam used for the aging is T° C., the autoclave containing the board is subjected to vacuum, e.g. 100 mm Hg absolute pressure, treatment. When the vacuum is continued for a long period of time at for example at 100 mm Hg absolute pressure, as is obvious from the diagram of FIG. 1, water vaporizes from the board until the temperature of the board reaches 50° C.

Figure 1:
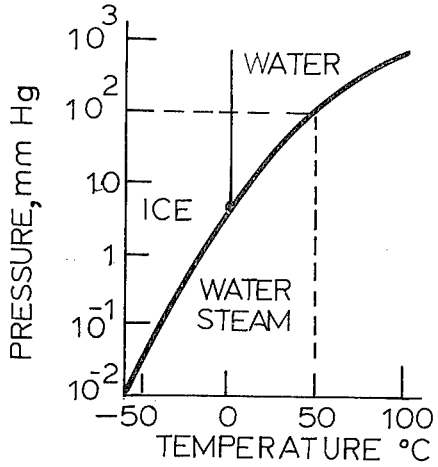
FIG. 1 depicts a diagram showing the relation between pressure and temperature of water steam vapor.

Turning briefly to FIG. 1, there is depicted a graph showing the transformation of water dependent upon pressure and temperature. For example at a pressure of $10^2$ mm Hg and 50° C. temperature, there is a transition point between water and steam.

Since at about 50° C. the water steam amount vaporized from the board per unit time is comparatively small, when the above vacuum state is maintained until the temperature of the board reaches 70° C., the following equation is applicable.

$$W = (T-70)\,(C)\,(1000)/B \qquad (2)$$

wherein "B" Kcal/kg denotes the calories required for evaporation; "W" in grams denotes vaporized water quantity per unit 1 Kg of board material; and (T−70) (C) Kcal/kg denotes the calories releasedby the board material during decrease of temperature from T° C. to 70° C.

In the above case, if the temperature T° C. of the board to be dried is 143° C., the calories required to vaporize the water from the board is 512 Kcal/kg. On the other hand, the calories required to vaporize the water from the board at 70° C. is 557.5 Kcal/kg. Consequently, the term "B" closely resembles the mean value of the two, namely, 534.8 Kcal/kg. It should be noted that we have used interchangeably the terms "evaporate" and "vaporize". Accordingly, if the initial temperature of the heated board is 143° C., the above mentioned amount of vaporized water "W" is shown as follows:

$$W = [(143 - 70)\,(C)/534.8] \times 1000 \qquad (3)$$

The following equation may be derived from (1) and (3):

$$W = (730)/534.8 \times [M + A(100 - M)] \qquad (4)$$

When a board having an original weight of 1000 grams is subjected to vacuum treatment until the temperature of the core of the board reaches 70° C., the weight of the board becomes (1000 − W) grams. The water content of the board becomes (10M − W) grams when the board having a water content of (1000)×(M/100) grams is subjected to vacuum treatment until the temperature of the board reaches 70° C. Consequently, the water content of the board, after maintaining the vacuum state until the temperature reaches 70° C., is as follows:

$$D = \frac{10M - \frac{730}{534.8}M + A(100-M)}{1000 - \frac{730}{534.8}M + A(100-M)} \times 100 \qquad (5)$$

As above stated, the temperature of the board is reduced by vacuum treatment until the core is about 70° C. and then the board is heated up to 143° C. by a treatment using saturated steam at about 143° C. in the autoclave. The cycles of cooling using vacuum and subsequently heating using saturated steam, may be repeated until the water content of the board is stepwisely reduced to the amount desired. It has been found that the number of cycles is preferably ten (10) or less.

After cooling the board down to 70° C. by vacuum treatment, saturated steam is supplied again to the autoclave. In this case, a part of the initially supplied saturated steam will condense on the surface of the board and generate liquid water which is then partly absorbed into the board material, and results in an increase of water content in the board of about 1% or less.

Figure 2:
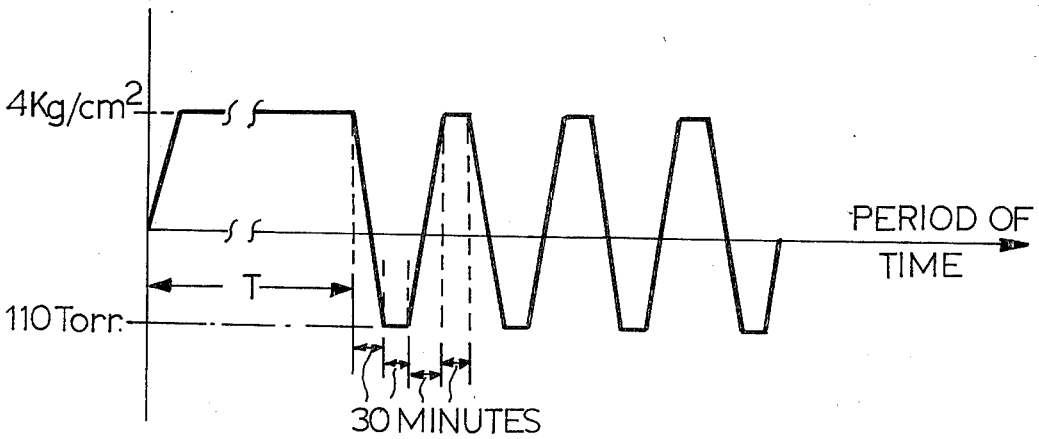
FIG. 2 depicts a graph plotting the aging, and a plurality of cycles of vacuum treatment and saturated steam treament against time.

The diagram of FIG. 2 shows pressure plotted against time and illustrates the pressure and time in an embodiment of the invention. It is understood, however, that other pressures and times and temperatures can be used in the invention by applying the above equations. In an illustrative embodiment, an autoclave was used having a diameter of 600 mm and length of 1000 mm, and the boards were about 450 mm width, 3030 mm length, and 11 mm thick. The aging step and drying steps were done with saturated steam of 143° C. and 4 Kg/cm$^2$. A vacuum of 110 Torrs was used. In FIG. 2, "T" denotes the time of aging in the autoclave. After aging, the board material in the autoclave had a water content of about 50%. Specific heat "A" of bone dried board material is about 0.15. The approximate water content of the board after autoclave aging and vacuum treatment may be calculated from equation (5) as about 45%, by assuming that the water content "M" of the board material is about 50%. The water content of the board may increase about 1% due to absorption of water condensed by the vacuum treatment. Thus, the approximate water content of the board which is to be subjected to a second drying cycle of vacuum application and saturated steam application is about 46%. Accordingly by applying equation (5) in which "M" is estimated at 46%, the water content of the board material after the second drying cycle can be calculated to be about 41%.

Similarly, the water content of the board prior to the third drying cycle is about 42% (which is 41% obtained from the second drying cycle plus 1% increase due to condensation from that second cycle). Accordingly, the approximate water content of the board after the third drying cycle is calculated from equation (5) to be about 36%. "M" was estimated to be 42% in the equation. After seven drying cycles, the water content of the board will be less than 20%. The percents are in terms of weight unless otherwise stated. Thus, advantageously, in a stepwise manner, the water content of the board is reduced and such adverse effects as warping and exfoliation are prevented.

The invention, is not limited to the specific data above shown. The inventors have discovered that a range of pressures, temperatures and times of application of saturated steam, vacuum and saturated steam, produced advantages effects.

In a preferred embodiment, the board material is first prepared, for example, by using a paper making process. The board composition and other steps are discussed herein in greater detail. After the boards are prepared, they are placed in an autoclave for age hardening. Saturated steam under a pressure within the range of 2 to 12 kg/cm$^2$, and at a temperature of within the range of 120 to 190° C., and for a period of time within the range of 8 to 16 hours, was supplied to the autoclave to effect the hardening. The specific pressures, times and temperatures, as long as within the above ranges, would depend upon the thickness of the board and composition.

After age hardening, the boards are left in the autoclave and subjected to one or more drying cycles to dry the boards to a desired water content. The drying cycles consist essentially of first a vacuum treatment conducted at a pressure within the range of 60 to 300 Torrs, and for a sufficient period of time, such as 30 minutes, to enable the temperature of the core of the board to reach a predetermined temperature, such as 70° C.; and then a saturated steam treatment, wherein the steam is at a pressure within the range of 2 to 12 kg/cm$^2$, at a temperature within the range of 120 to 190° C., and for a sufficient period of time, such as 30 minutes, to enable the core to reach a predetermined temperature, such as 143° C.

In one example, discussed hereinabove, the steam was at a temperature of 143° C. and a pressure of 4 kg/cm$^2$. As shown in FIG. 2 the steam was applied in the drying cycle for 30 minutes, and the vacuum of 110 Torrs was applied for 30 minutes. Between the alternate applications of the steam and vacuum, the transition was about 30 minutes. The saturated steam applied in the aging step was for 8 to 16 hours. The dimensions of the board were 450 mm width, 3030 mm length, and 11 mm thick. Seven drying cycles were used to bring down the water content stepwisely to below 20%.

It was discovered that when a pressure of 300 Torrs was used it took a longer period of time for application of vacuum than for lower pressures. At less than 60 Torrs, the water in the board will violently boil out therefrom, and is liable to bring about breakdown of the board. At a pressure of 60 Torrs, the water evaporates from the board until the temperature of the board becomes 50° C. Since evaporation of water from the board at about 50° C. is very slow, the vacuum treatment is conducted until the temperature of the board becomes 70° C. At pressures of 300 Torrs, the water evaporates from the board until the temperature of the board reaches about 75° C. But, since the evaporation of water at about 75° C. is very slow at that pressure, the vacuum treatment is conducted until the temperature of the board is about 95° C., at that pressure of 300 Torrs.

In the preferred embodiment, the drying cycles are repeated a number of times until the optimum or desired water content is achieved. The preferred number of cycles is 10 or less.

Figure 3:
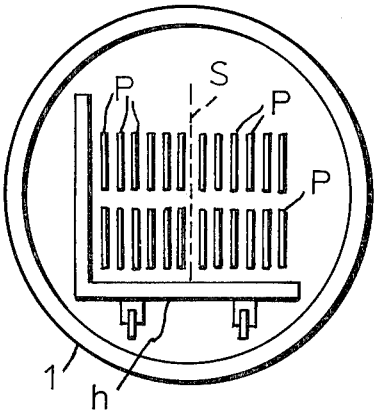
FIG. 3 depicts pictorially an autoclave with a plurality of boards placed therein for aging and drying treatments.

In accordance with the invention, in FIG. 3, the boards "P" are housed in an autoclave 1. The boards are arranged, advantageously, to stand upright and in a line, for example, on a truck frame "H" for conveying the boards into and out of the autoclave. By arranging the boards in the manner depicted in FIG. 3, face to face mechanical contact pressure between the boards P can be reduced and more efficient aging and drying can be achieved. Also gaps between the boards can be suitably adjusted and fixed. The heating and cooling are more uniform. Spacers "S" such as of the wire mesh type, may be placed between the boards, as depicted in FIG. 3. By using spacers S, the above mentioned gaps can be accurately and uniformily adjusted and fixed. Also, advantageously the mesh catches and holds water condensed in its meshes, and restrain the increase in water content resulting from condensation to less than 1%.

Figure 4:
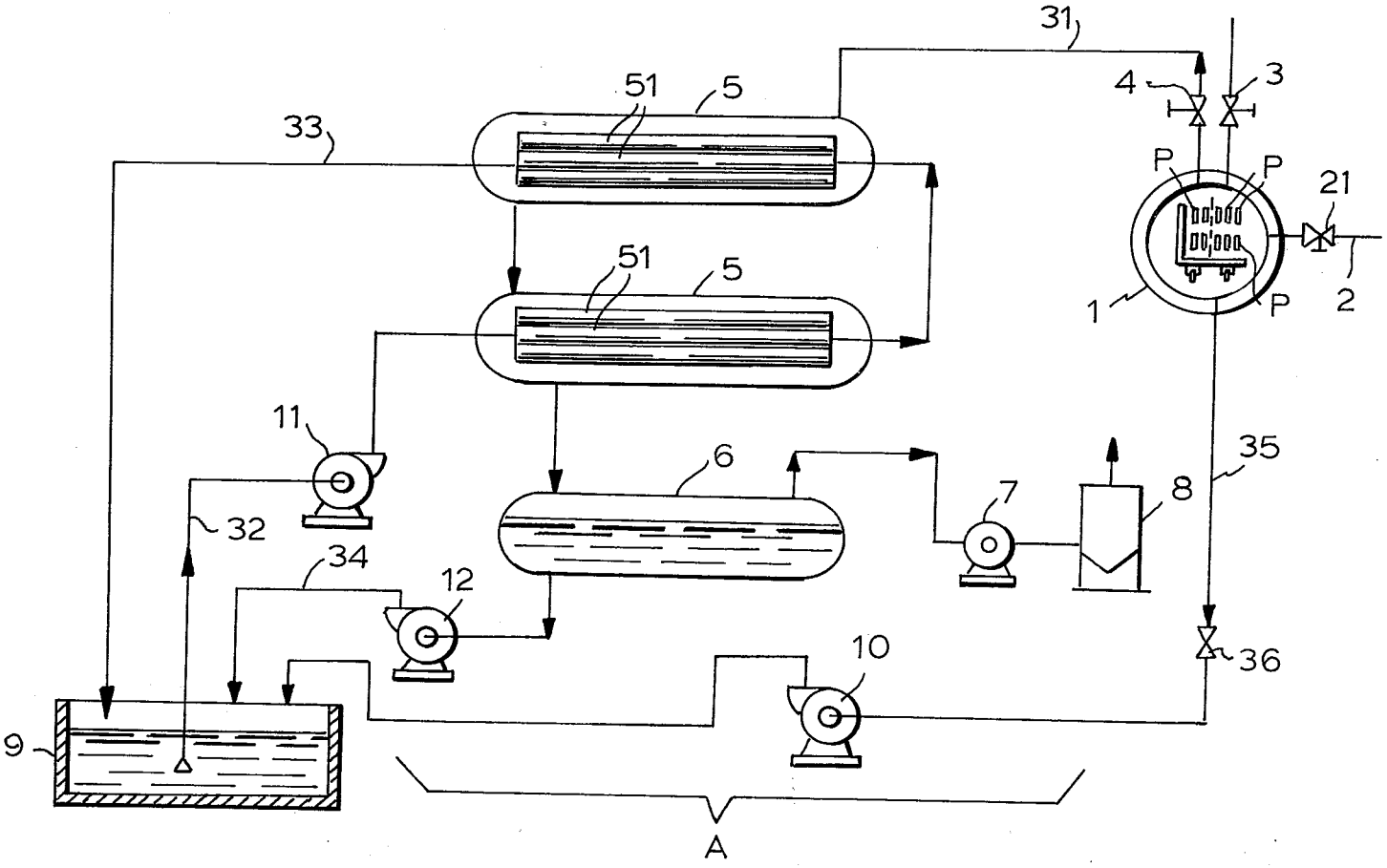
FIG. 4 depicts pictorially the inventive system used to age the board and then to dry the board.

FIG. 4 depicts an illustrative system of equipment used in the invention. Autoclave 1, having boards "P" contained therein, is equiped with a steam supply pipe 2, which is communicated to a boiler, not shown, via valve 21. Also, autoclave 1 has a vacuum breaking valve 3 connected thereto. Autoclave 1 is connected to a vacuum system "A" which comprises valve 4, cooling tanks 5,5 which are of the multiple cooling pipes type, condensed water tank 6, vacuum pump 7 and gas exhaust tower 8. Water condensed in tank 6 is pumped by pump 12 into a water tank 9. Water from tank 9 is also pumped via pipe 32 and pump 11 to supply cooling water to cooling pipes 51,51 of the cooling tanks 5,5 and back via pipe 33 to tank 9.

In operation, in one example, after the primary vacuum breaking of the autoclave by use of valve 3, boards P are heated to a predetermined temperature (for example 143° C.) with steam supplied through pipes 2, and then valve 21 is closed. With opening of valve 4, the autoclave is placed under vacuum and kept at a desired predetermined vacuum pressure, for example 110 Torrs, for a fixed period of time, such as 30 minutes.

The steam contained in the exhaust gas exhausted from the autoclave through pipes 31 is led into cooling tanks 5 in order to condense the saturated steam to water. The obtained condensed water is delivered through condensed water tank 6, into water tank 9 by exhausting pump 12, via pipe 34. Condensed water in the autoclave is exhausted by water exhausting pump 10 via pipe 35 and open valve 36.

According to the present invention, boards containing a variety of types of inorganic material can be manufactured. One example of an industrially producable board was obtained from the slurry set forth hereinafter and using a paper making process. The slurry was made with suitable quantity of water; 1 to 10 weight parts of monocarboxylic acid salt of light metal; and 100 weight parts of raw material comprising 15 to 55 weight parts of silicic acid type material, lime type material in a quantity which is 0.4 to 1.2 times the molar amount of silicic acid type material, 2 to 20 weight parts of cement, 5 to 25 weight parts of asbestos, 1 to 15 weight parts of pulp, and 0.05 to 0.5 weight parts of synthetic fibers. By the usual paper making process raw boards were produced which were then aged, and then subjected to the drying cycles outlined hereinabove, to thereby reduce the water content of the board in a stepwise manner to that desired.

In the above example, there was careful attention paid to minimizing porosity of calcium silicate and to reducing the water absorbability of the boards made of hydrated calcium silicate by using monocarboxylic acid metal salt as a water expelling agent. The obtained boards were suitable for outdoor use.

In order to maintain the water expelling property of the monocarboxylic acid metal salt in the same condition in the autoclave, the pressure of the saturated steam is preferably maintained during the aging step to be within the range of 2 to 12 Kg/cm$^2$ and the treating period is preferably within the range of 8 to 16 hours. The monocarboxylic acid light metal salt was used in an amount of between 1 to 10 weight parts because less than 1 weight part would not produce sufficient water proofness of the product and more than 10 weight parts would tend to cause the layers of the board wound onto a preparing roll to exfoliate. As an example of a monocarboxylic acid light metal salt, calcium stearate is especially preferable.

The molar ratio of lime type raw material to silicic acid type raw material is preferably within the range of 0.4 to 1.2 in order to prevent efflorescence of the board product and restraining creation of free lime. Examples of lime materials are preferably lime, slaked lime, carbide slag, etc. Examples of silicic acid type material are preferably diatomaceous earth, silica powder, clay, ferrosilicon dust, fly ash, etc. A part of the silicic acid type raw material may remain unreacted. This unreacted silicic acid type raw material is also useful as aggregate for matrix. The total amount of the raw materials of silicic type and lime type is preferably between 20 to 100 weight parts. When this amount is less than 20 weight parts, the obtained board does not have the necessary property of lightness possessed by boards of the calcium silicate type. On the other hand, when this amount is more than 100 weight parts, the obtained board has poor strength and in the course of manufacturing the raw boards cut and peeled off from a making roll, has poor strength due to excess amount in comparison to the cement preferably employed.

The amount of cement added is kept within the range of 2 to 20 weight parts because when the amount is less than 2%, the resulting strength of the raw board and the strength of the board product are not satisfactory. Using more than 20 weight parts of cement would effectively cause loss of the characteristics of the calcium silicate board. Cement is added to enhance the efficiency of the paper making process in producing the board from solid material contained in the slurry, and to produce the proper strength and dimensional stability of the obtained board product.

Pulp may be added to improve construction workability, such as sawability and nail driving ability. The amount of pulp added is kept within the range of 1 to 15 weight parts because less than 1 weight part of the product would not produce any satisfactory improvement in the construction workability, and would necessitate addition of asbestos by more than 25 weight parts. Although use of more than 15 weight parts would reduce the amount of asbestos which would need to be added, such amount of over 15 weight parts would substantially reduce the strength and dimensional stability.

Synthetic fibers may be added to improve impact strength of the product. The synthetic fiber must be of a type having sufficient toughness so that when exposed to the above aging process, the fiber does not degredate. Polypropylene and polyvinyl alcohol fibers are preferable examples of such synthetic fibers. The amount of synthetic fiber used is preferably kept within the range of 0.05 to 0.5 weight parts because less than 0.05 weight part does not produce sufficient impact strength of the board. Use of more than 0.5 weight part causes inhomogeneous mixing of the synthetic fiber in the slurry due to the bulk of the fibers. Also, the impact strength obtained from use of over 0.5 weight parts is more than necessary, and the increased impact strength does not offset the disadvantages of increased difficulty of mixing.

In order to carry out the example, first the above mentioned raw materials are mixed well with water with agitation by using a pulper, to obtain a slurry containing about 10% of the raw materials. The water used may be ordinary tap water, industrially servicable water, or recovered water, such as recovered from a paper making plant system by filtration. In the slurry prepration step, pulp, synthetic fibers and monocarboxylic acid salt of light metal are mixed with water. Then, the obtained mixture liquor may be placed, with stirring, together with asbestos, cement, lime type material, silicic acid material, into a pulper.

The resulting slurry may be supplied to a container from which the slurry may be continuously fed to a vat of a wet machine. The slurry in the vat is then led onto a pulp making cylinder to make thin sheets thereof. The resulting sheet is transferred onto a felt belt of excellent water permeability and is wound to make a roll. When the thickness of the wound up sheet reaches a certain thickness, the sheet layers are cut and peeled off from the making roll and the obtained sheet is conveyed to a press to subject same to press treatment. Since the thusly obtained raw sheet has sufficient strength and is resistant against deformation and breakage due to its moderate cement combination, the raw sheet board can be safely subjected to the pressing treatment.

The raw board is dehydrated with a presser. The pressure of the pressing is normally about 60 to 140 $Kg/cm^2$. If desired, a pattern may be embossed thereon by using a mold in the presser. Dehydrated raw sheet boards are then piled up and placed in an aging chamber equipped with pressure steam pipes. By supplying steam into the aging chamber, the raw sheet boards are preliminarily prehardened. The prehardening contributes toughness to the raw sheet board which may then be cut into suitably shaped boards. After prehardening, the raw sheet boards may be cut into boards of predetermined sizes. The prehardening may be omitted if the sheet board are subsequently cut or trimmed.

Then, the raw sheet boards "P" are disposed vertically with spacers "S" therebetween onto a vehicle bed "H", as depicted in FIG. 3, and then conveyed into the autoclave 1, and is further aged with steam in the manner as above discussed. This aging acts to further harden the boards and may be referred also herein as a hardening step. The raw boards are hardened by the hydration reaction of calcium silicate and hydration reaction of cement. The hydration reaction of calcium silicate is stopped before Tobermolite is generated. Satisfactorily lower porosity of the product is acquired. Furthermore, monocarboxylic acid salt of light metal does not melt and decompose and retains sound water expelling properties.

After hardening in the autoclave, the boards are subjected to one or more drying steps comprising vacuum treatment, followed by steam treatment, as discussed hereinbefore in greater detail. Then the dried product may have plastic painted thereon as desired.

The obtained product has lowwater absorbing property on account of its low porosity and its holding of water expelling constituent substance. Substantially all of the lime material reacting with the silicic acid material, is converted into hydrated calcium silicate. During use of the product, occurence of efflorescence phenomenon can be avoided. Also, the synthetic fibers contained is neither melted nor decomposed and retain their original shape, and the product has satisfactory impact strength.

The foregoing description is illustrative of the principles of the invention. Numerous other variations and modifications thereof would be apparent to the worker skilled in the art. All such variations and modifications are to be considered to be within the spirit and scope of the invention.

What is claimed is:

1. A method for producing inorganic boards, comprising the steps of (A) forming inorganic boards from a water slurry containing inorganic materials;

(B) placing the boards in an autoclave and supplying saturated steam under pressure of between 2 and 12 $kg/cm^2$, at a temperature of about 120 to 190° C., for a period of time of from 8 to 16 hours, thereby to harden said boards; and (C) subjecting the hardened boards to one or more drying cycles consisting essentially of the sequential steps of (i) subjecting the boards to a vacuum of 60 to 300 Torrs in the same autoclave for a period of time sufficient to enable the core of the boards to reach a predetermined temperature, and (ii) subjecting the boards to saturated steam in the same autoclave, at a pressure of from 2 to 12 $Kg/cm^2$, at a temperature within the range of 120 to 190° C., and for a period of time sufficient to enable the core of the boards to reach a predetermined temperature, thereby stepwisely reducing the moisture content of the boards to a value desired.

2. The method of claim 1, wherein said vacuum is applied until the core of said boards reach about 70° C., and said saturated steam in the drying cycle is applied until the core of said boards reach about 143° C.

3. The method of claim 1, wherein said hardened boards are subjected to 10 or less drying cycles.

4. The method of claim 1, wherein said vacuum is applied for about 30 minutes in each cycle.

5. The method of claim 1, wherein said saturated steam is applied at a temperature of about 143° C. and at a pressure of 4 $Kg/cm^2$.

6. The method of claim 1, wherein said boards are placed in said autoclave in a vertical position and in a line in a lateral direction with spacers therebetween.

7. The method of claim 1, wherein said boards are produced by a paper making process, employing a slurry made from a predetermined quantity of water, 1 to 10 weight parts of monocarboxylic acid salt of light metal; and 100 weight parts of raw materials consisting essentially of 15 to 55 weight parts silicic acid type material, lime type material of 0.4 to 1.2 molar times the quantity of silicic acid type material, 2 to 20 weight parts cement, 5 to 25 weight parts asbestos, 1 to 15 weight parts pulp, and 0.05 to 0.5 weight part of synthetic fibers.

* * * * *